US008079493B2

(12) United States Patent
Taylor

(10) Patent No.: US 8,079,493 B2
(45) Date of Patent: Dec. 20, 2011

(54) BLOW MOLDED UNIVERSAL LID

(76) Inventor: Craig V. Taylor, Chatsworth, CA (US)

( * ) Notice: Subject to any disclaimer, the term of this patent is extended or adjusted under 35 U.S.C. 154(b) by 0 days.

(21) Appl. No.: 12/823,392

(22) Filed: Jun. 25, 2010

(65) Prior Publication Data

US 2010/0258577 A1 Oct. 14, 2010

Related U.S. Application Data

(63) Continuation of application No. 11/415,348, filed on May 1, 2006, now Pat. No. 7,743,937, which is a continuation-in-part of application No. 11/289,180, filed on Nov. 29, 2005, now Pat. No. 7,413,100, which is a continuation of application No. 10/143,295, filed on May 10, 2002, now Pat. No. 6,968,972.

(60) Provisional application No. 60/677,432, filed on May 2, 2005.

(51) Int. Cl.
*B65D 43/16* (2006.01)

(52) U.S. Cl. ..... 220/844; 220/908; 220/380; 220/781; 220/782; 206/515; 206/505; 206/508

(58) Field of Classification Search ..... 206/508, 206/505, 515; 220/844, 380, 781, 782
See application file for complete search history.

(56) References Cited

U.S. PATENT DOCUMENTS

| | | | | | |
|---|---|---|---|---|---|
| 4,335,828 | A * | 6/1982 | Robinson et al. | ..... | 220/826 |
| 4,342,402 | A * | 8/1982 | Jungles | ..... | 220/848 |
| 4,445,623 | A * | 5/1984 | Kolling et al. | ..... | 220/844 |
| 4,650,089 | A * | 3/1987 | Sanders | ..... | 220/848 |
| 4,771,940 | A * | 9/1988 | Taylor | ..... | 220/832 |
| 4,949,866 | A * | 8/1990 | Sanders | ..... | 220/810 |
| 5,088,616 | A * | 2/1992 | Susko et al. | ..... | 220/844 |
| 5,423,448 | A * | 6/1995 | Pedigo | ..... | 294/68.2 |
| 5,447,251 | A * | 9/1995 | Taylor | ..... | 220/523 |
| 5,564,586 | A * | 10/1996 | Goodwin | ..... | 220/844 |
| D388,579 | S * | 12/1997 | Taylor | ..... | D34/11 |
| 5,868,267 | A * | 2/1999 | Taylor | ..... | 220/826 |
| 5,975,345 | A * | 11/1999 | Taylor | ..... | 220/826 |
| 6,000,550 | A * | 12/1999 | Simpson et al. | ..... | 206/711 |
| 6,616,008 | B2 * | 9/2003 | Lemajeur | ..... | 220/826 |
| 6,758,366 | B2 * | 7/2004 | Bourgund et al. | ..... | 220/836 |
| 6,968,972 | B2 * | 11/2005 | Taylor | ..... | 220/844 |
| 2001/0017302 | A1 * | 8/2001 | Bourgund et al. | ..... | 220/836 |
| 2003/0146230 | A1 * | 8/2003 | Eaton et al. | ..... | 220/826 |
| 2004/0178196 | A1 * | 9/2004 | Sholinder | ..... | 220/4.33 |
| 2005/0224507 | A1 * | 10/2005 | Gavin et al. | ..... | 220/836 |

* cited by examiner

*Primary Examiner* — Anthony Stashick
*Assistant Examiner* — Christopher McKinley
(74) *Attorney, Agent, or Firm* — Fulwider Patton LLP

(57) ABSTRACT

A lid for industrial or commercial large size solid waste containers has a ribbed single layer central portion and a peripheral edge having a hollow double wall boxed configuration. The lids have substantial symmetry so that the lids may be stacked and nested with alternate lids oriented in opposite front-to-back directions.

6 Claims, 8 Drawing Sheets

FIG. 19
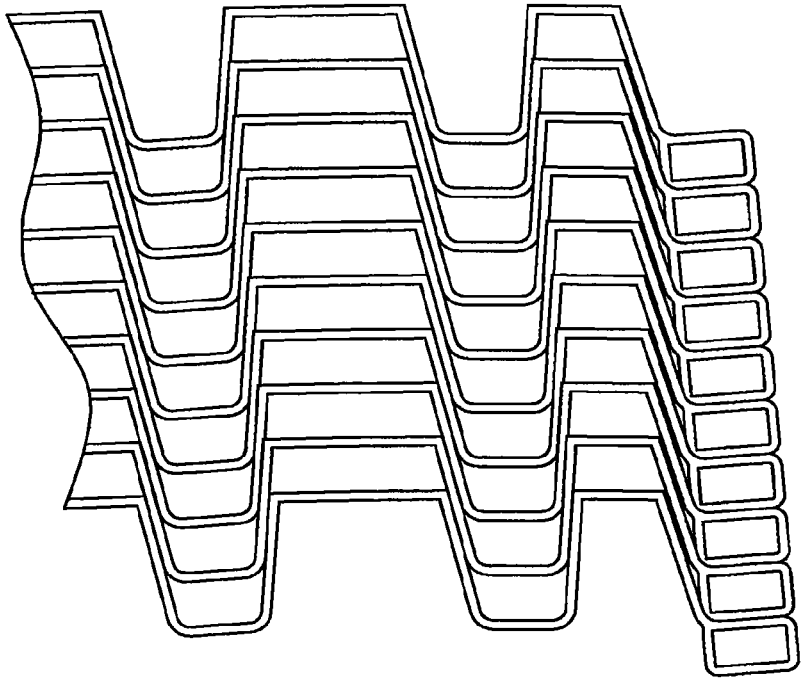
FIG. 20
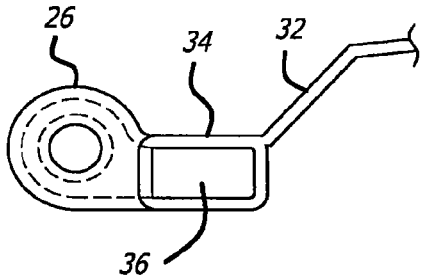
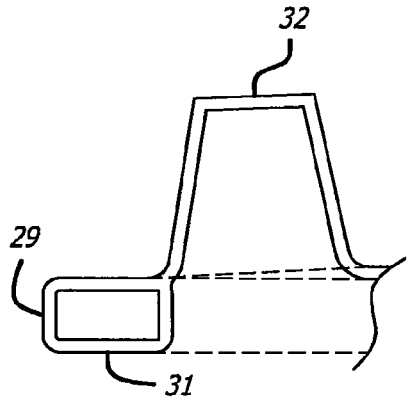
FIG. 21
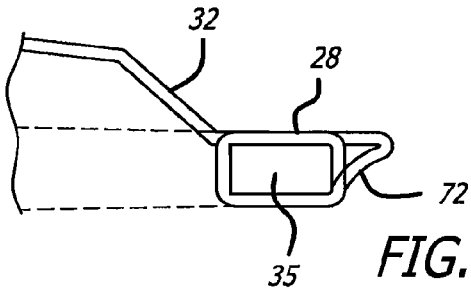
FIG. 22

BLOW MOLDED UNIVERSAL LID

CROSS-REFERENCES TO RELATED APPLICATIONS

This application is a continuation application of Ser. No. 11/415,348, filed May 1, 2006, now U.S. Pat. No. 7,743,937, which is a continuation-in-part application of Ser. No. 11/289,180, filed Nov. 29, 2005, now U.S. Pat. No. 7,413,100, which is a continuation of Ser. No. 10/143,295, filed May 10, 2002, now U.S. Pat. No. 6,968,972, and is based on provisional application Ser. No. 60/677,432, filed May 2, 2005.

FIELD OF THE INVENTION

For more than 25 years, there have been two basic types of plastic lids for large commercial and industrial (1 cubic yd.-16 cubic yd.) solid waste containers. They have been either, a single sheet of plastic formed with various rib configurations, or a hollow double wall fabrication with an even greater variety of ribbing combined with partial fusion of the top and bottom walls. Each type has significant advantages as well as known drawbacks.

Single Wall Lid Advantages:

Both types of lids are limited to a maximum weight of approximately 15 pounds for lifting ease. Therefore, the double wall type has approximately half the wall thickness of its single wall counterpart. In the highly abusive environment of the solid waste industry, the thicker single wall lids last longer due to the simple fact that it is inherently more cut, puncture and abrasion resistant. The thicker wall also resists UV degradation far longer. Double wall lids will also allow the ingress of rainwater when punctured. This may result in an unwanted shower for the user when the lid is rotated open or closed. In winter conditions when the water is frozen to ice, the lids can become too heavy for the user to lift. Single wall lids do not retain water except in the open horizontal position and are easily emptied in a controlled fashion.

For any given rib height, the single wall additional thickness increases the load bearing of the rib by the cube of the increase in the thickness (i.e. if you double the thickness of the rib wall, the stiffness is increased 8 times). Load bearing is important for safety; primarily with regard to children playing on top of a container. Additionally, load bearing is required to resist collapse of the lid into the container due to excessive snow loads or trash bags piled on top of the lids.

The delivery and storage costs of single wall lids are nearly half the cost of double wall lids. Single wall lids rest one on the other every vertical one-half inch. The typical double wall lid has a vertical nesting depth of nearly two inches per lid. A full truckload of double wall lids weights about 23,000 lbs. (1560 lids) whereas a full truckload of single wall lids weighs about 40,000 lbs. (2700 lids). The same issues affect the amount of storage space required throughout the distribution process.

Double Wall Lid Advantages

The double wall lid is superior to the single wall lid with regard to usability, i.e., the person opening the lid to deposit trash prefer the double wall type because it will not twist laterally when lifted off center as is the case with single wall lids. Standing to one side and lifting off center is necessary when depositing larger articles or trash bags as the typical lid in a pair will only provide an opening which is 30 inches to 36 inches wide.

This lateral twisting is a problem for the user because the side of the lid opposite that which is raised with one hand will not lift to the same height as the other (typically 12 or more inches lower) and will effectively block the deposit of trash with the users other hand. This is not a mere annoyance, because in most cases and especially on larger containers, the user will throw open the lid over the back of the container and leave it in the open position due to the difficulty of retrieving the lid and closing it. In communities where they are used, it is not uncommon to find the majority of large waste containers with the lids left open. This condition is obviously unsightly and creates a real health and litter problem in any community.

The double wall lid has significantly stronger hinge lugs than single wall lid fabrications. This is especially true of rotationally molded and blow molded double wall lids. Most single wall fabricating techniques stretch the material thinner in all raised areas such as ribs and hinge lugs. Furthermore, the hole for the hinge rod is drilled through the thinner stretched wall. This 9/16 inches to 11/16 inches diameter hole is by necessity ½ inch to ⅝ inches from the edge of the plastic fabricated sheet. When stressed, the ½ inch diameter hinge rod can pull through the edge with relative ease.

The double wall hinge hole for the lid pivot shaft extends through the side of a boxed hinge lug that has no nearby edge to pull through. This type of fabrication requires the hinge rod to be pulled through the entire side and back wall of the boxed lug in order to fail. Even with double wall fabrications that stretch the wall material thinner as in typical single wall fabrication, the double wall boxed lug is far stronger and will hold the lid on the container far longer than is the case for single wall lids.

SUMMARY OF THE INVENTION

The new lid design effectively combines the best features and eliminates the worst of both basic lid types on the market today, the single wall thermoform, rotomolded or compression molded lid and the double wall rotomolded, blow molded or twin sheet thermoformed lid.

The new design is 90% single wall construction except for the perimeter and the hinge lug area. The perimeter has a hollow double wall substantially closed cross-section, preferably boxed-like or rectangular in cross-section. The hinge lug area is preferably also a double wall fabrication. The hollow substantially closed perimeter edge dramatically reduces the typical single wall lateral deflection.

The vertical nesting depth of the new lid may be one inch, the thickness of the boxed perimeter of the lids, even though the hinge lug may be a full one and three quarters inches in thickness, in a specific illustrative embodiment. The significance of this is simple. A one inch nesting depth allows the lid to ship 2700 pieces at 40,000 lbs. per truckload. This is equal to the shipping efficiency of the typical single wall lid without sacrificing hinge lug strength. The hinge lug is the same as its double wall rotationally molded or blow molded counterpart. This combination of features is accomplished with a unique alternate nesting design. This design allows each lid to be positioned on top of the other fully nested to the one perimeter edge thickness with each successive lid juxtaposed lengthwise in the opposite direction from the lid underneath. Accordingly, the total height of a stack of lids is equal to the number of lids multiplied times the height of the boxed edges, plus the height of the ribs of one lid, above its hollow closed edge.

In accordance with a broader aspect of the invention, a lid for commercial or industrial solid waste containers comprises a central ribbed area of the lid formed of a single layer of plastic and a perimeter with a hollow substantially closed cross-sectional configuration, having a predetermined thickness. The hinge lug area has a double wall construction and is substantially thicker, but is equal to or less than twice as thick as the predetermined thickness of the perimeter hollow edges. In addition the lids are substantially symmetrical so that they may be stacked with each lid reversed in its front-to-rear orientation, relative to the adjacent lids, and with the front of the lid being shaped to provide clearance for the "over-size" hinge lugs. These and other forms of the invention will become apparent from a consideration of the following detailed description and from the accompanying drawings.

BRIEF DESCRIPTION OF THE DRAWINGS

FIG. 19 is a partial cross-sectional view of a stack of lids showing the sides of the lids.

FIG. 20 is an enlarged cross-sectional view of the hinge lug as indicated at 20-20 of FIG. 8.

FIG. 21 is an enlarged cross-sectional view of the hinge lug as indicated at 21-21 of FIG. 7.

FIG. 22 is an enlarged cross-sectional view of the hinge lug as indicated at 22-22 of FIG. 8.

DETAILED DESCRIPTION OF THE PREFERRED EMBODIMENTS OF THE INVENTION

Figure 1:
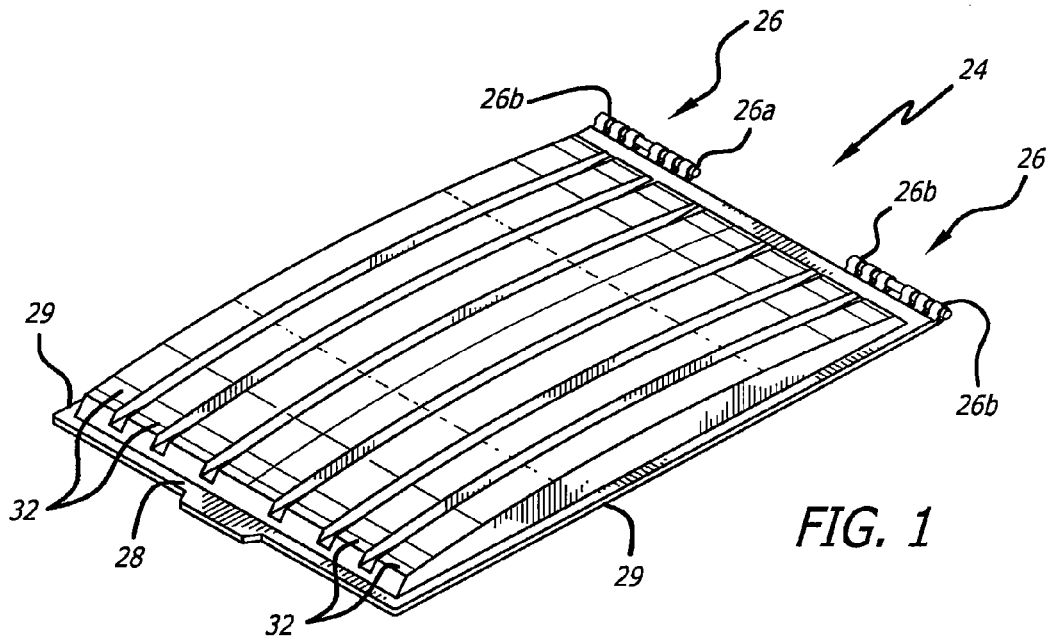
FIG. 1 is a perspective view of a first embodiment of a lid according to the invention.
Figure 3:
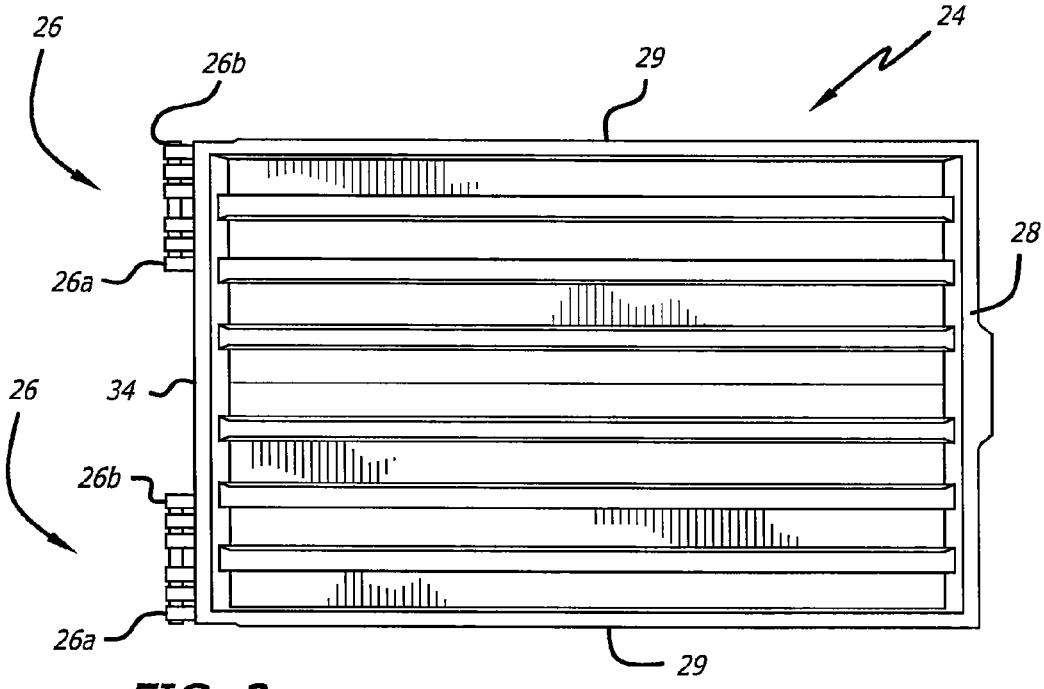
FIG. 3 is a bottom plan view of the lid of FIG. 1.
Figure 2:
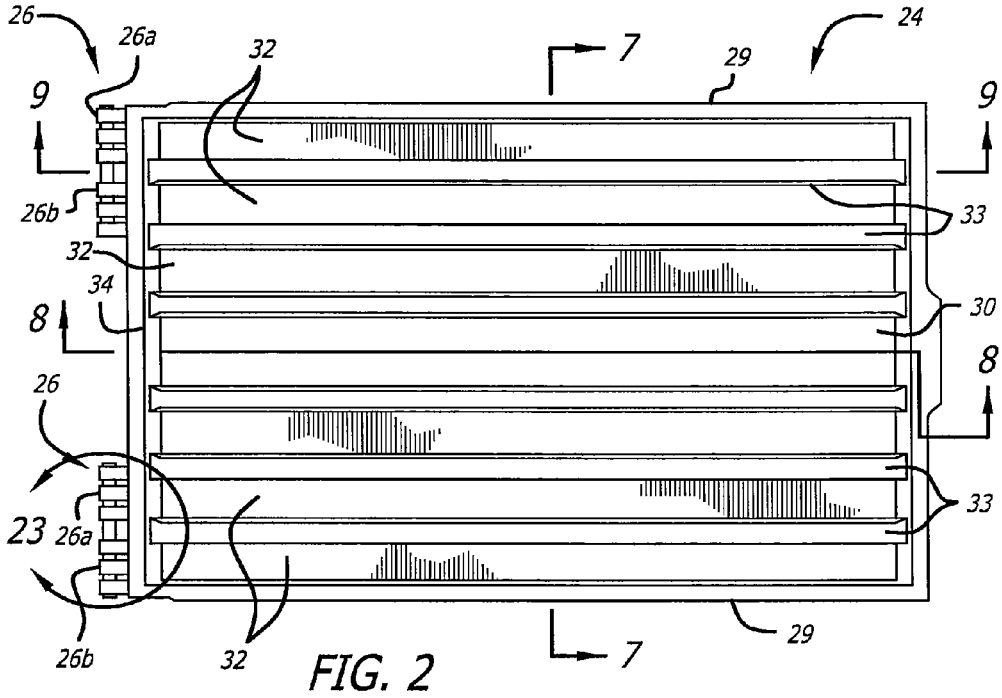
FIG. 2 is top plan view of the lid of FIG. 1.
Figure 4:
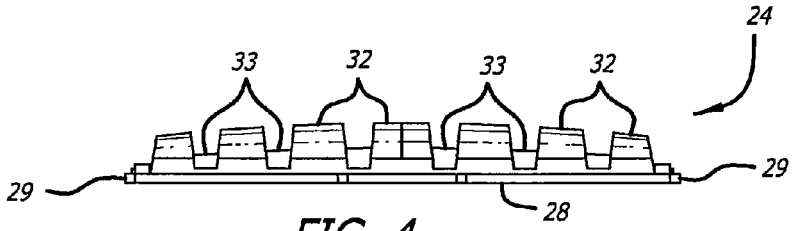
FIG. 4 is a front view of the lid of FIG. 1.
Figure 5:
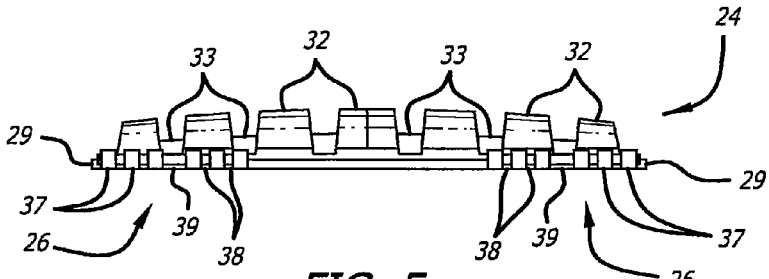
FIG. 5 is a rear view of the lid of FIG. 1.
Figure 6:
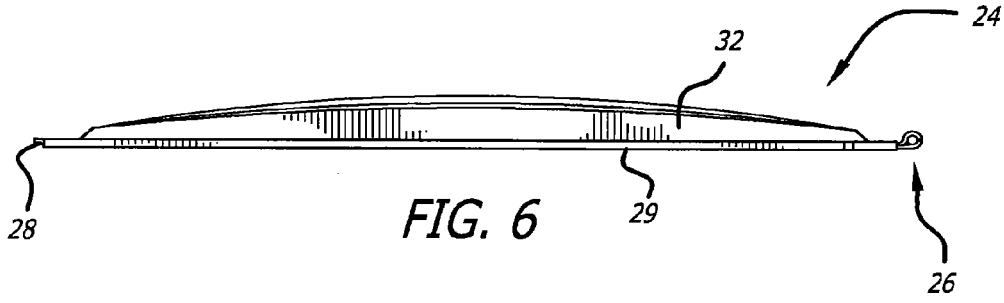
FIG. 6 is a right side view of the lid of FIG. 1, of which the left side view is substantially a mirror image.

Referring to the drawings, in a first embodiment illustrated in FIGS. 1-9, the lid 24 has a rear edge 34 with a plurality of enlarged hinge lugs 26 thereon. The front edge 28 of the lid is shaped to provide clearance for the hinge lugs. The lid has two sides 29 which have a hollow boxed cross-sectional configuration 31. In addition, the central portion 30 of the lid is a single, fairly thick layer of plastic, preferably about 3/16 inch thick, and preferably made of polyethylene, although other plastic materials may be employed. The central portion of the lid has a series of raised ribs or protrusions 32, spaced apart by intervening wells or depressions 33, which increase the stiffness or rigidity of the overall lid.

The boxed cross-sectional configuration is preferably employed around the full perimeter of the lid. The front edge thus also has the hollow boxed configuration 35, as well as a shape to provide clearance for the enlarged hinge lugs upon stacking. Between the lugs, the rear edge 34 of the lid includes a boxed cross-sectional configuration 36 from which the hinge lugs extend.

As is shown in FIGS. 1-3, 5 and 23, in a presently preferred aspect, for improved strength and structural stability, the enlarged hinge lugs at the rear edge of the lid include relatively thicker tubular portions 37 connected by relatively thinner or recessed tubular web portions 38, and are preferably grouped in right and left side pairs of first and second sets of hinges 26*a* and 26*b*, spaced apart by a recessed portion or notch 39. The ribs are substantially symmetrical front-to-rear, so that when the lids are stacked with alternate lids reversed in front-to-back orientation, there is no interference between the ribs of successive lids.

Figure 7:
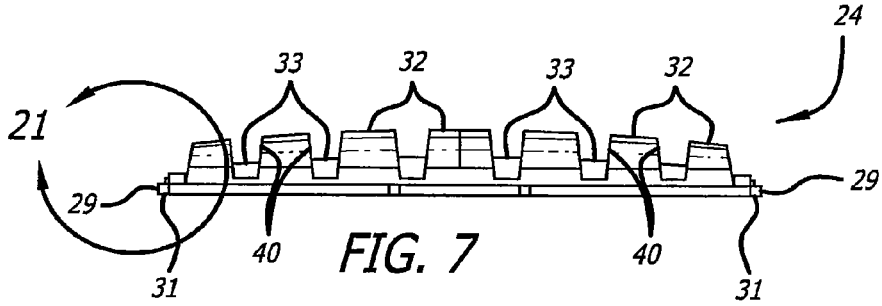
FIG. 7 is a cross-sectional view, taken along line 7-7 of FIG. 2.
Figure 8:
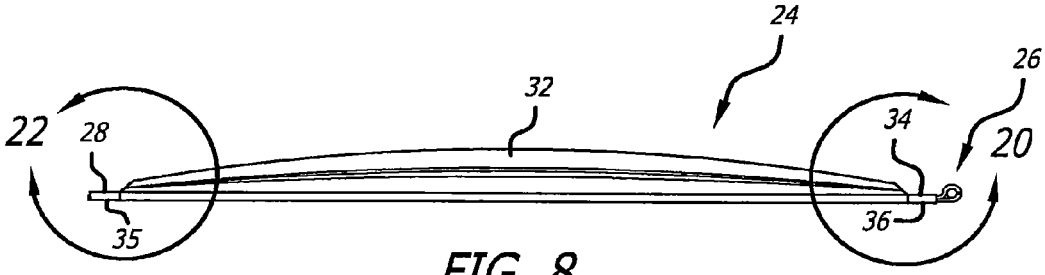
FIG. 8 is a cross-sectional view, taken along line 8-8 of FIG. 2.
Figure 9:
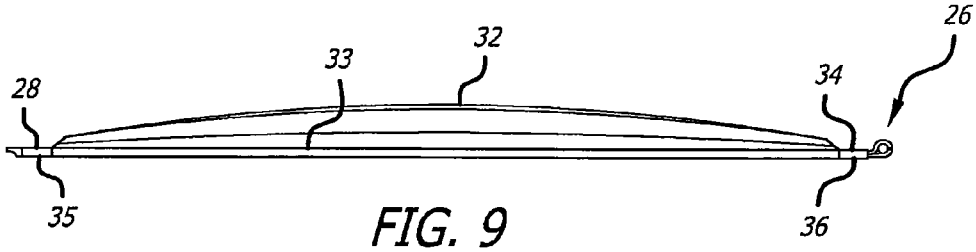
FIG. 9 is a cross-sectional view, taken along line 9-9 of FIG. 2.

As is best seen in FIG. 7, in one aspect, the ribs and rib sidewalls 40 are slanted in order to facilitate stacking.

Figure 18:
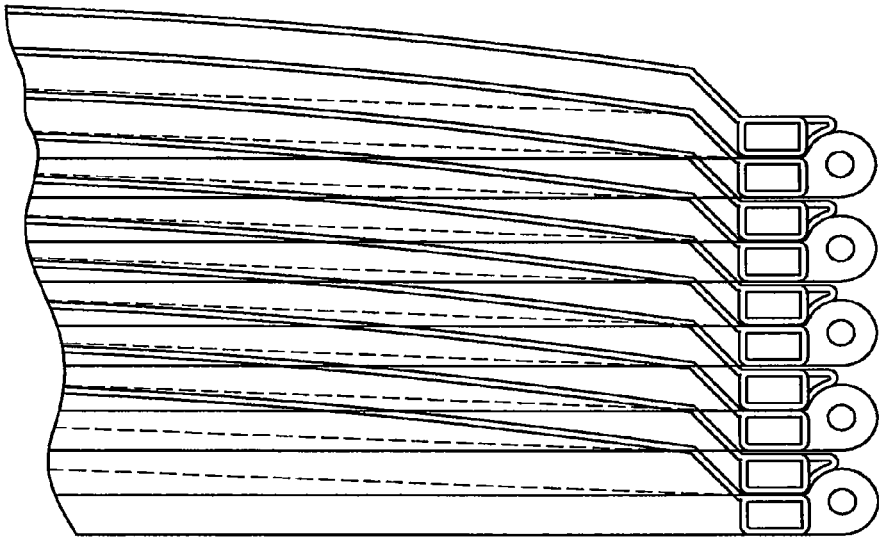
FIG. 18 is an illustration of a stack of lids according to the present invention, with the lids alternated in their orientation, front-to-back.
Figure 23:
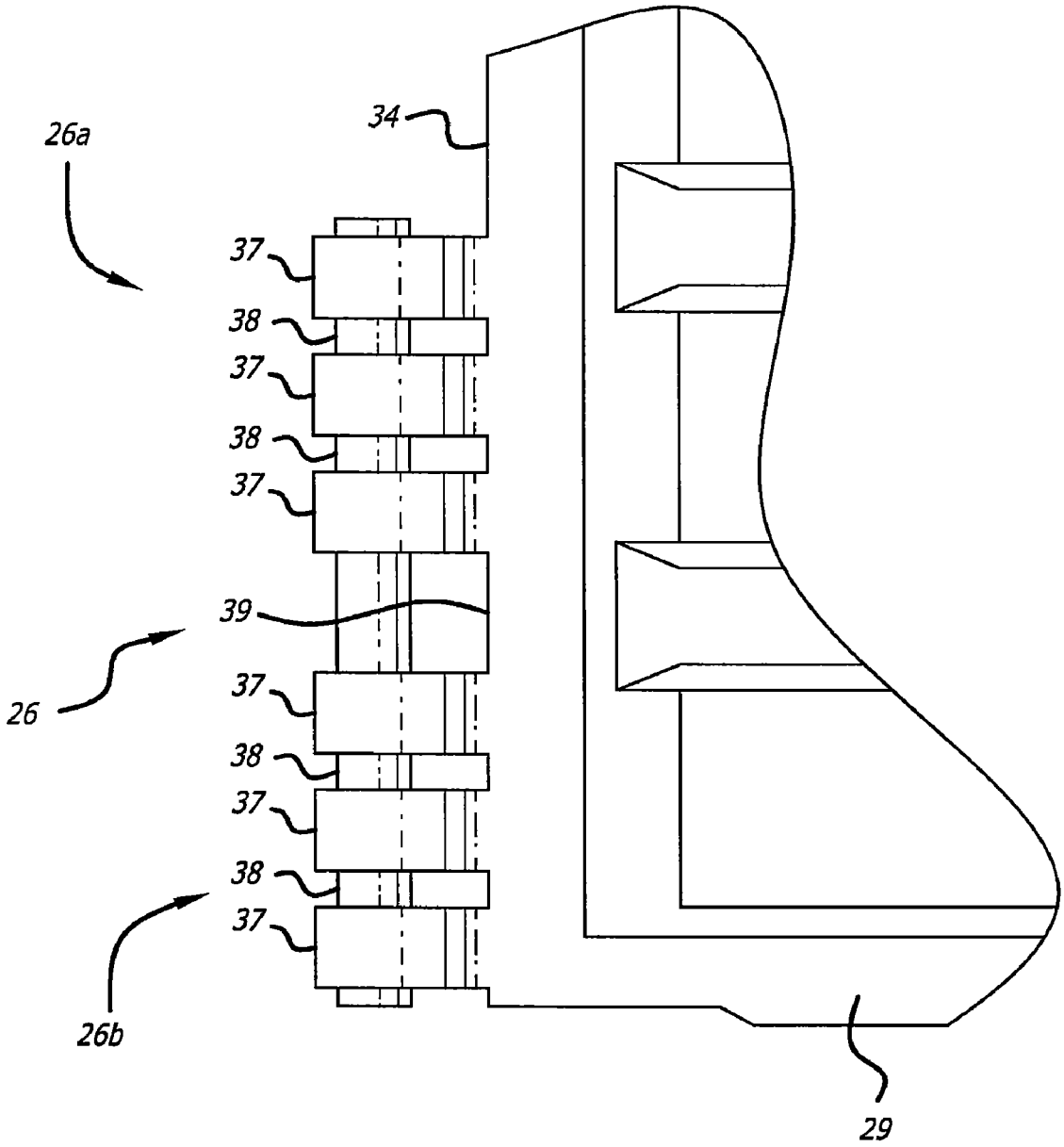
FIG. 23 is an enlarged view of a pair of first and second sets of hinges as indicated at 23-23 of FIG. 2.

As is illustrated in FIG. 18, the lid fits closely over the hinge lugs when the lids are nested, with alternate lids typically facing in opposite directions. Thus, the lids alternatingly have hinge lugs facing to the right and to the left. The front edge of the lids are shaped and dimensioned to easily fit adjacent to the enlarged hinge lugs of the lids. The ribs are substantially symmetrical, so that they readily fit within one another, and within the one inch space provided by the boxed perimeter configuration of the lid.

Referring to FIG. 19, the edges of all the lids rest upon one another, and provide the standard spacing between successive lids which may be one inch, for example. The lids are also formed in a substantially symmetrical configuration, so that the alternate lids which are oriented in opposite directions longitudinally, readily fit together.

Figure 10:
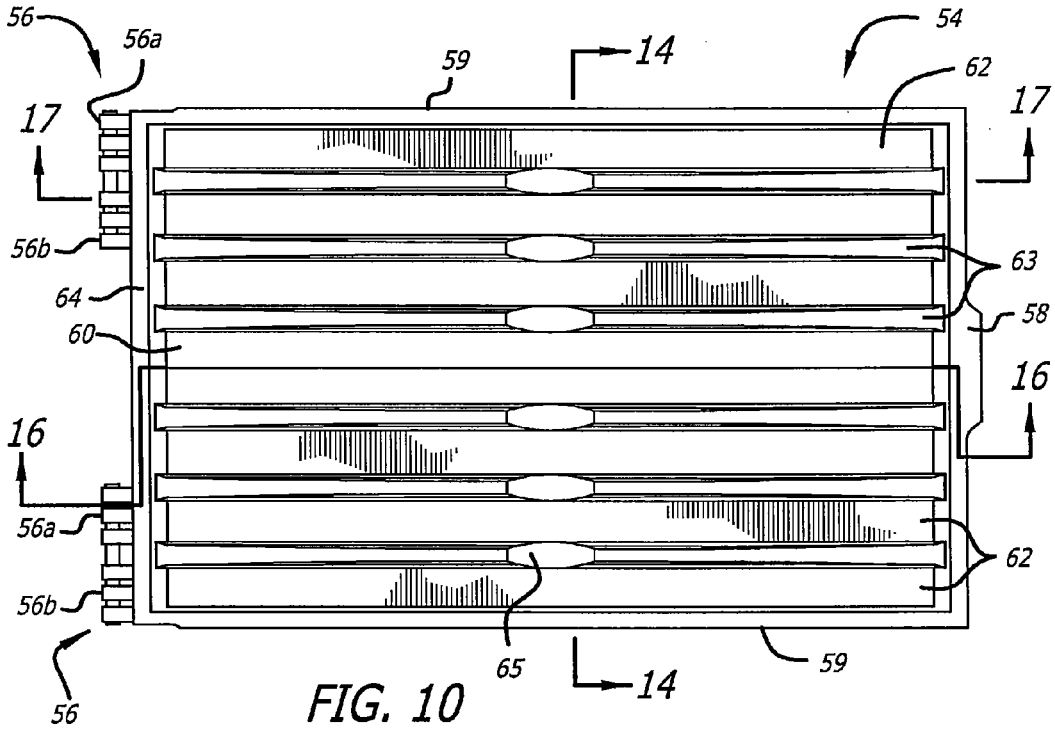
FIG. 10 is top plan view of a second embodiment of a hinge lid according to the invention.
Figure 11:
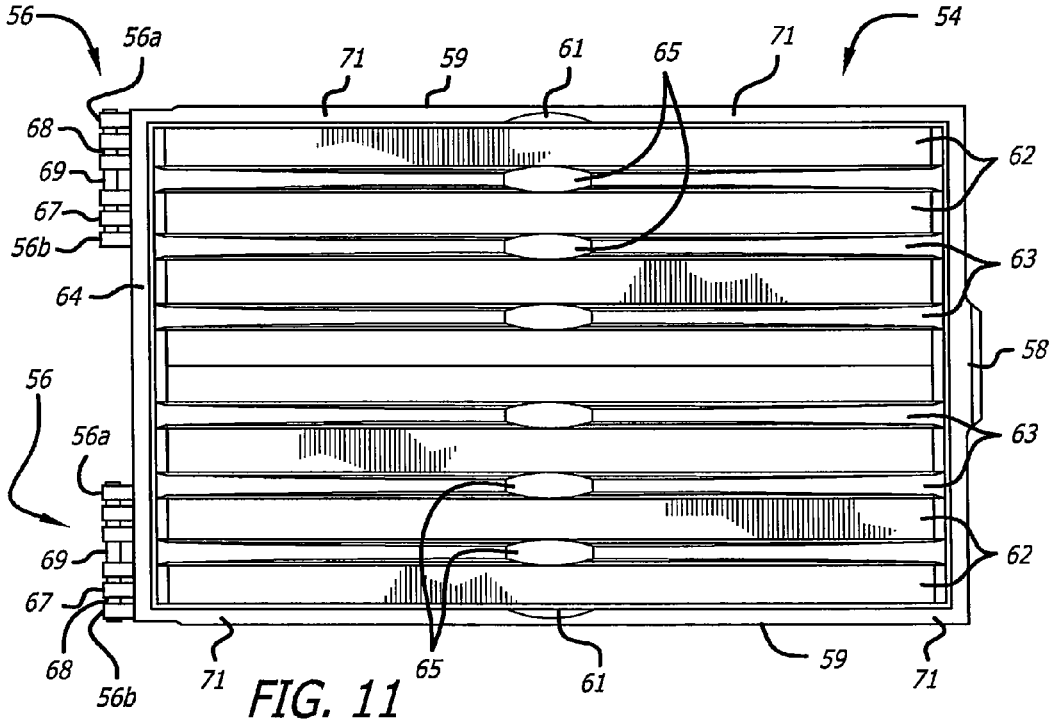
FIG. 11 is a bottom plan view of the lid of FIG. 10.
Figure 12:
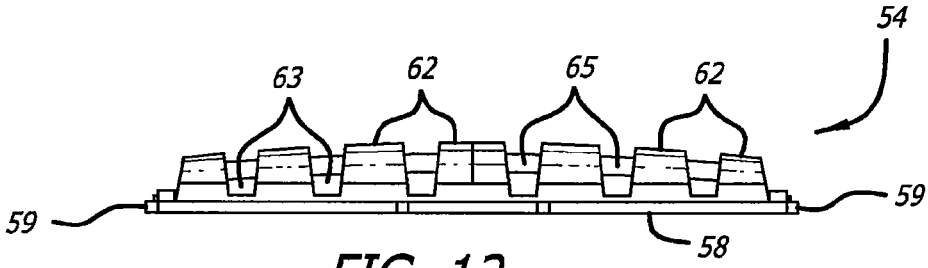
FIG. 12 is a front view of the lid of FIG. 10.
Figure 16:
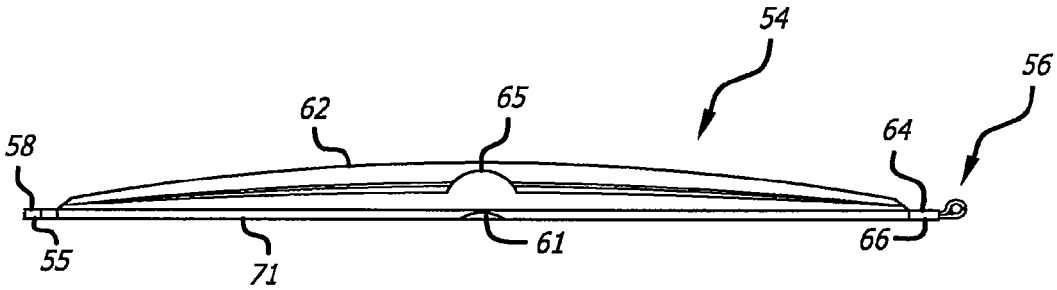
FIG. 16 is a cross-sectional view, taken along line 16-16 of FIG. 10.
Figure 15:
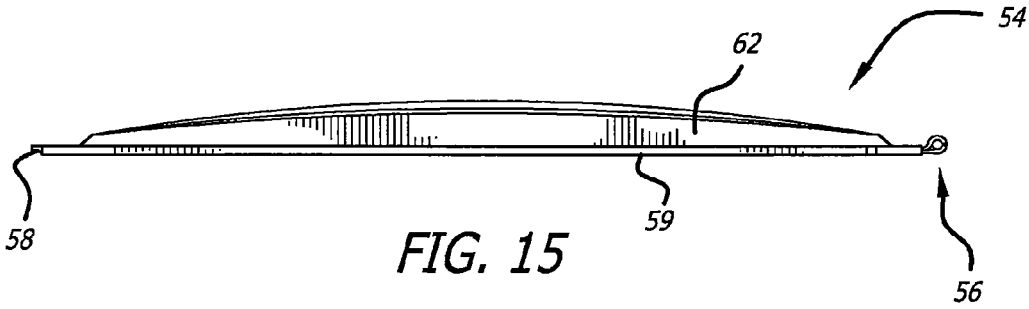
FIG. 15 is a right side view of the lid of FIG. 10, of which the left side view is substantially a mirror image.
Figure 17:
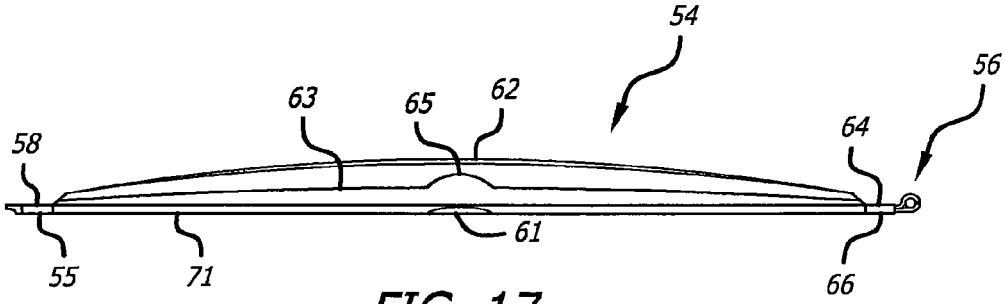
FIG. 17 is a cross-sectional view, taken along line 17-17 of FIG. 10.

In a second embodiment illustrated in FIGS. 10-17, the lid 54 has a rear edge 64 with a plurality of enlarged hinge lugs 56 thereon. The front edge 58 of the lid is shaped to provide clearance for the hinge lugs. The lid has two sides 59 which have a hollow boxed cross-sectional configuration 57. In addition, the central portion 60 of the lid is a single, fairly thick layer of plastic, preferably about 3/16 inch thick, and preferably made of polyethylene, although other plastic materials may be employed. The central portion of the lid has a series of raised ribs or protrusions 62, spaced apart by intervening wells or depressions 63 which include generally central raised or arched portions 65, which allow the lid to bend and substantially recover when the lid is forced into a partially filled hopper of a disposal vehicle as often occurs when a trash container is emptied. As is illustrated in FIGS. 11 and 16, the sides also have an indented raised middle portion 61 in the bottom wall 71 of the side hollow boxed configuration, generally in line with the raised or arched portions of 65.

The boxed cross-sectional configuration is preferably employed around the full perimeter of the lid. The front edge thus also has the hollow boxed configuration 55, as well as a shape to provide clearance for the enlarged hinge lugs upon stacking. Between the lugs, the rear edge 64 of the lid includes a boxed cross-sectional configuration 66 from which the hinge lugs extend.

Figure 13:
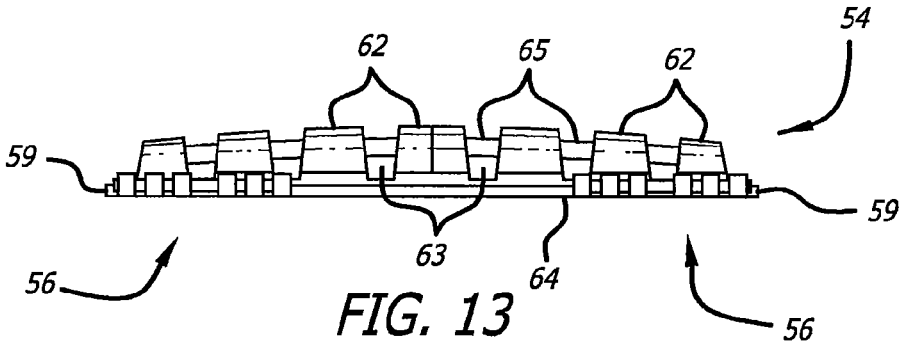
FIG. 13 is a rear view of the lid of FIG. 10.

As is shown in FIGS. 10, 11 and 13, in a presently preferred aspect, for improved strength and structural stability, the enlarged hinge lugs at the rear edge of the lid include relatively thicker tubular portions 67 connected by relatively thinner or recessed tubular web portions 68, and are preferably grouped as double hinges 56*a* and 56*b*, spaced apart by a recessed portion or notch 69. The ribs are substantially symmetrical front-to-rear, so that when the lids are stacked with alternate lids reversed in front-to-back orientation, there is no interference between the ribs of successive lids.

Figure 14:
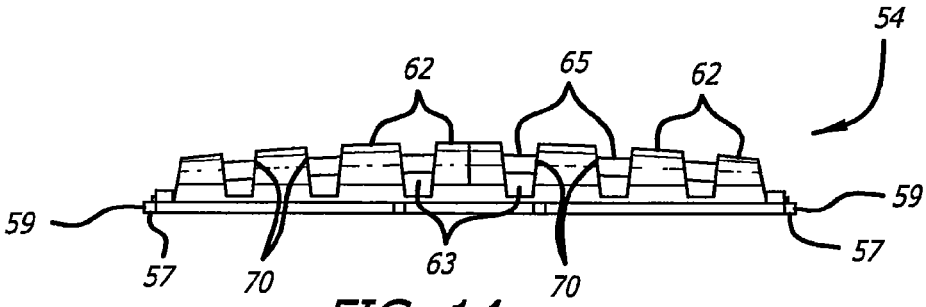
FIG. 14 is a cross-sectional view, taken along line 14-14 of FIG. 10.

As is best seen in FIG. 14, in one aspect, the ribs and rib sidewalls 70 are slanted in order to facilitate stacking.

As in the first embodiment, the lid fits closely over the hinge lugs when the lids are nested, with alternate lids typically facing in opposite directions. Thus, the lids alternatingly have hinge lugs facing to the right and to the left. The front edge of the lids are shaped and dimensioned to easily fit adjacent to the enlarged hinge lugs of the lids. The ribs are substantially symmetrical, so that they readily fit within one another, and within the one inch space provided by the boxed perimeter configuration of the lid.

The edges of all the lids rest upon one another, and provide the standard spacing between successive lids which may be one inch, for example. The lids are also formed in a substantially symmetrical configuration, so that the alternate lids which are oriented in opposite directions longitudinally, readily fit together.

The boxed configurations of the first embodiment illustrated in FIGS. 20-22 apply equally well to the boxed configurations of the second embodiment. The boxed configuration 36 of the rear edge is clearly shown in FIG. 20 as well as the enlarged hinge lugs 26. FIG. 21 is an enlarged cross-sectional view of the side edges of the lid bearing the reference numeral 19, and clearly showing the boxed configuration extending around the lid. In addition, a rib 32 is shown, with the rib 32 being of single plastic wall construction, forming part of the central section 30 of the universal lid, which, as mentioned above, is substantially of a single wall configuration. FIG. 22 is an enlarged cross-sectional view of the front edge 28 of the lid, showing the beginning of a rib 32, and a special configuration 72 of the lower portion of the front edge which fits closely over the hinge lugs 26 when the lids are nested, with alternate lids facing in opposite directions.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A plastic lid for large commercial and industrial solid waste containers, comprising:

a central main portion of said plastic lid having a single wall cross-sectional configuration;

a front perimeter edge portion, a rear perimeter edge portion, and two side perimeter edge portions connected to said central main portion, said two side perimeter edge portions having a substantially hollow boxed double wall cross-sectional configuration; and a plurality of hinge lugs along said rear perimeter edge portion, said hinge lugs including a plurality of tubular portions connected together by tubular web portions, said plurality of tubular portions being radially thicker than said tubular web portions.

2. The plastic lid of claim 1, wherein said central main portion of said plastic lid comprises a plurality of raised ribs spaced apart by intervening wells.

3. The plastic lid of claim 1, wherein said plurality of hinge lugs are grouped in right and left side pairs of first and second sets of hinges spaces apart by a recessed portion.

4. The plastic lid of claim 1, wherein said two side perimeter edge portions have a bottom wall with an indented raised middle portion.

5. The plastic lid of claim 2, wherein said intervening wells each include a central raised portion.

6. The plastic lid of claim 5, wherein said central raised portion is arched.

* * * * *